United States Patent [19]

Segal

[11] Patent Number: 4,790,296

[45] Date of Patent: Dec. 13, 1988

[54] SEXUAL STIMULATION APPARATUS

[76] Inventor: Daniel A. Segal, 19433 Pacific Coast Hwy., Malibu, Calif. 90265

[21] Appl. No.: 36,919

[22] Filed: Apr. 10, 1987

[51] Int. Cl.[4] ..... A61H 7/00

[52] U.S. Cl. ..... 128/51; 128/52; 128/79; 128/44

[58] Field of Search ..... 128/43, 52, 79, 51

[56] References Cited

U.S. PATENT DOCUMENTS

| | | | |
|---|---|---|---|
| 1,210,809 | 1/1917 | Johansen | 128/52 |
| 2,128,790 | 8/1938 | Barbour | 128/52 |
| 2,905,170 | 9/1959 | Seaman | 128/33 |
| 3,504,665 | 4/1970 | Bakunin et al. | 128/79 |
| 3,511,229 | 5/1970 | Romo | 128/52 |
| 3,724,451 | 4/1973 | Santo | 128/52 |
| 3,874,373 | 4/1975 | Sobel | 128/79 |
| 3,910,262 | 10/1975 | Stoughton | 128/79 |
| 4,175,554 | 11/1979 | Gerow | 128/79 |
| 4,291,686 | 9/1981 | Miyashiro | 128/52 |
| 4,513,737 | 4/1985 | Mabuchi | 128/52 |
| 4,640,270 | 2/1987 | Chin | 128/79 |
| 4,722,327 | 2/1988 | Harvey | 128/44 |

FOREIGN PATENT DOCUMENTS

| | | | |
|---|---|---|---|
| 2437053 | 2/1976 | Fed. Rep. of Germany | 128/79 |
| 2606869 | 9/1977 | Fed. Rep. of Germany | 128/79 |

*Primary Examiner*—Edgar S. Burr
*Assistant Examiner*—Aaron J. Lewis
*Attorney, Agent, or Firm*—Kelly, Bauersfeld & Lowry

[57] ABSTRACT

An apparatus for engaging the glans of a user to provide sexual stimulation includes an electric motor situated within a box-like, sound insulated container, an elongated arm extending through a container aperture and having a first end coupled to a drive shaft turned by the motor, and a glans engaging attachment fixed to a second end of the elongated arm. A drive wheel having a plurality of apertures therethrough is attached to the drive shaft, and an intermediate arm is pivotally attached at one end to the elongated arm and at the other end to the drive wheel. This has the effect of translating the rotational motion of the drive shaft into reciprocating and substantially linear motion of the elongated arm along its longitudinal axis. In one preferred form, the glans engaging attachment comprises a dildo member having a projecting shaft held securely adjacent the second end of the elongated arm. In another preferred form, the glans engaging attachment includes a rigid bell having an outwardly projecting tubular shaft held securely adjacent the second end of the elongated arm, and a soft tubular sleeve placed onto the bell in a manner forming a receptacle for the glans penis.

19 Claims, 1 Drawing Sheet

SEXUAL STIMULATION APPARATUS

BACKGROUND OF THE INVENTION

This invention relates generally to devices for providing sexual stimulation, and, more specifically, to mechanized devices capable of reciprocating a glans engaging attachment to simulate sexual intercourse.

It is well recognized that the sexual drive is one of the most basic and urgent of all human drives. Over the years various devices have been utilized to aid in sexual encounters, e.g. dildos, ticklers, and the like. Many such devices are designed to be utilized directly in the sexual activity or as an adjunct to sexual intercourse. Other such devices, such as the exercise device of U.S. Pat. No. 4,048,985, are utilized to develop skills useful during sexual intercourse.

With the recent development and discovery of the Acquired Immune Deficiency Syndrome (A.I.D.S.) virus, many formerly sexually active people are attempting to abstain from sexual activity. The human sexual drive, however, is such that it cannot be ignored. It has been found that extended sexual frustration can lead to physiological and psychological problems which can negatively effect everyday life, work and social behavior.

Although condoms have been promoted as one method for protecting oneself against exposure to the A.I.D.S. virus, intercourse utilizing condoms is not 100% safe, even when properly used. The fear of contracting the A.I.D.S. virus, coupled with the inhibiting and perhaps demeaning prospect of asking prospective sex partners about his or her latest sexual contacts, is changing the way many people view their own human sexuality and their relationships with others.

Accordingly, there is a need for a sexual stimulation apparatus capable of providing a safe and hygienic sexual release, which also eliminates the fear of contracting communicable diseases such as A.I.D.S. or Venereal Disease. Such an apparatus should enable the user to achieve an orgasm without exchanging body fluids with a partner, and require minimum manipulation after being set up and adjusted to ones specific needs. Further, a sexual stimulation apparatus is needed which can be powered by ordinary household electrical current, is self-contained and lightweight, is easy to clean and store, and which can be used by males or females. Additionally, a sexual stimulation apparatus is needed which can be used to help overcome frigidity, or to facilitate the collection of semen for artificial insemination purposes. The present invention fulfills these needs and provides other related advantages.

SUMMARY OF THE INVENTION

The present invention resides in a novel sexual stimulation apparatus which is quiet and compact, enables the user to achieve an orgasm without exchanging body fluids with a partner, and is totally hygienic. The stimulation apparatus comprises, generally, motor means situated within a sound insulating container, an elongated arm having a first end coupled to the motor means and which extends through a wall of the container, and a glans engaging attachment fixed to a second end of the elongated arm outside the container. The elongated arm is coupled to the motor means in a manner translating the rotational motion of a drive shaft into reciprocating and substantially linear motion of the elongated arm along its longitudinal axis.

In a preferred form of the invention, the container includes a base portion, a lid hinged to the base portion, vent means to facilitate air circulation within the interior thereof, handle means, and at least one aperture through the base portion. The motor means is positioned within the container and secured to the base portion. The container is preferably constructed of sound insulating material so that noise generated by the motor means within the container is greatly diminished exteriorly thereto.

The motor means includes an electric motor which turns a drive shaft. To this end, gear means are interposed between the electric motor and the drive shaft for translating a high rate of rotation of the electric motor into a slower rate of rotation of the drive shaft. Power supply and control means extend from a power source, through the container, to the electric motor. The power supply and control means includes a power cable having an on/off switch and a rheostat in line between the power source and the electric motor for controlling the electric motor.

Means for selectively coupling the first end of the elongated arm to the motor means includes a drive wheel attached to the drive shaft. The drive wheel includes a plurality of apertures radially spaced from one another. Further, an intermediate arm is pivotally attached at one end to the first end of the elongated arm, and further pivotally attached at another end to the drive wheel at one of the drive wheel apertures. The attachment between the intermediate arm and the drive wheel is effected through use of a bolt having spring-loaded ball means which prevents the unintentional separation of the intermediate arm from the drive wheel. Moreover, a rigid guide is placed about a portion of the elongated arm to position the arm, in connection with the container aperture, to insure reciprocating and substantially linear motion of the arm along its longitudinal axis.

An adjustable band in situated proximate the second end of the elongated arm, and the glans engaging attachment is securely held within the adjustable band. For a male user, the glans engaging attachment includes a rigid bell having a tubular shaft projecting therefrom. This shaft is securely held within the adjustable band when in use. A soft tubular sleeve is placed on the bell in a manner forming a receptacle for the glans penis. A flexible tube extends from the end of the tubular shaft opposite the bell to a constricting valve means, to place the interior of the bell in fluid communication with the valve means. This valve means is adjustable to permit the user to adjust the amount of suction on the glans penis when it is withdrawn from the receptacle.

Alternatively, the above-described glans engaging attachment for a male can be removed from the second end of the elongated arm by loosening the adjustable band, and placing therein an attachment suitable for use by a female. More specifically, a dildo member having a projecting shaft from one end thereof can be utilized. This projecting shaft would be held within the adjustable band proximate the second end of the elongated arm.

Further, the elongated arm itself can alternatively be constructed to include a plurality of telescoping sections which are held in an extended configuration by spring-loaded ball lock means. This has the advantage of providing the user a collapsible arm to facilitate storage of the apparatus.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
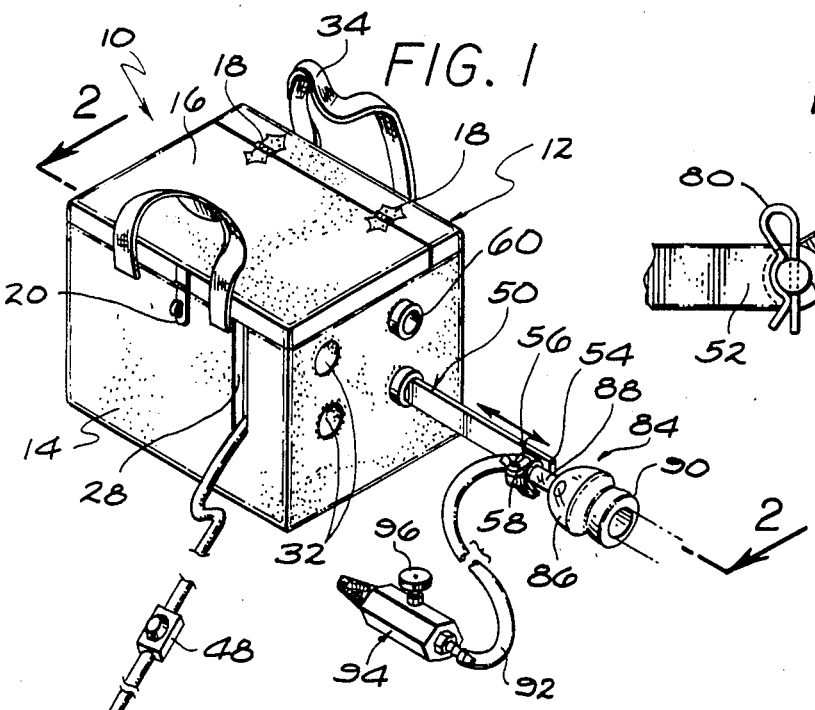
FIG. 1 is a perspective view of a preferred form of the sexual stimulation apparatus embodying the invention, and shown assembled with a glans engaging attachment for a male.

As shown in the drawings for purposes of illustration, the present invention is concerned with a novel sexual stimulation apparatus, generally designated by the reference number 10. In accordance with the present invention, and as illustrated with respect to a first embodiment in FIGS. 1 through 4, the stimulation apparatus 10 includes a box-like container 12 having a base portion 14 and a lid 16. The lid 16 is connected to the base portion 14 by hinges 18 to facilitate easy access to the interior of the container 12. To maintain the lid 16 in a closed position, a clasp 20 is provided.

The container 12 is constructed of rigid members 22 (such as wood) connected together in such a manner as to give the container strength and rigidity. These members 22 are surrounded by a sound insulating material 24, and a suitable covering 26 (such as leather or vinyl) is then placed over the sound insulating material 24 to provide a smooth and attractive interior and exterior surface for the container 12. Further, a slot 28 is provided in one of the walls of the container 12 to permit a flexible power cable 30 to extend therethrough. Moreover, a pair of vent apertures 32 are provided through the container 12 to facilitate circulation of air within the container interior. Handles 34 are connected to the base portion 14 near the upper edge of the container to facilitate carrying of the container by an individual. Finally, a pair of reciprocating arm apertures 36 are provided through a wall of the container for purposes which will become clear hereinafter.

An electric motor 38 is secured by means of screws 40 within the container 12 to the base portion 14. The electric motor turns a drive shaft 42 through a gear box 44 interposed between the electric motor and the drive shaft. This arrangement desirably translates the high rate of rotation of the motor 38 into a slower rate of rotation of the drive shaft 42. It has been found that a suitable unit including the electric motor 38, the gear box 44, and the drive shaft 42, can be found in a Dayton Gear Motor model 2Z803B, manufactured by Dayton Electric Manufacturing Company of Chicago, Ill. It is preferred that the maximum speed of the drive shaft be about 100 rpm.

The power cable 30 extends from a power source (not shown) through the slot 28 to the electric motor 38. An on/off switch 46 provides positive control over actuation of the electric motor 38. Further, a rheostat 48 is provided in the power cable 30 between the on/off switch 46 and electric motor 38 to permit a user to vary the speed of the electric motor. It should be apparent to one of ordinary skill in the art that although the on/off switch 46 and the rheostat 48 are illustrated as being part of a power cable 30 and independent of the container 12, it would be a simple matter to mount one or both of these controls directly onto the container 12.

An elongated arm 50 extends through one of the reciprocating arm apertures 36 of the container 12, and includes a first end 52 situated within the container, and a second end 54 situated externally of the container. The second end has an adjustable band 56 attached thereto, which preferably includes a wing nut 58 to facilitate manual tightening and loosening of the band 56. A sleeve 60 lines the aperture 36 through which the elongated arm 50 extends, to reduce wear on the container 12 and further to help align the elongated arm as it is caused to reciprocate in a linear fashion.

A drive wheel 62 is attached to the drive shaft 42, and includes a plurality of apertures 64 therethrough radially spaced from one another. An intermediate arm 66 is connected at one end to the drive wheel 62, and at the other end to the first end 52 of the elongated arm 50. As shown best in FIG. 4, the intermediate arm 66 is attached to the drive wheel 62 by aligning an aperture through an end of the intermediate arm 66 (not shown) with one of the drive wheel apertures 64, and holding the two components in a pivotable relationship by inserting a bolt 68. It is preferred that a washer 70 be placed between the bolt head and the adjacent portion of the intermediate arm 66, and further that the bolt 68 be provided a threaded portion 72 which can be fitted with a nut (not shown) if desired, and also spring-loaded balls 74 which prevent any unintended removal of the bolt 68 from the position shown.

Figure 3:
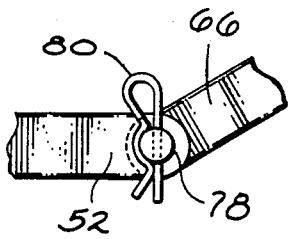
FIG. 3 is an enlarged elevational view of the pivotable joint between the elongated arm and an intermediate arm, as shown in FIG. 2, illustrating the use of an alternative pin arrangement which facilitates disassembly of the apparatus for transportation or storage purposes.
Figure 4:
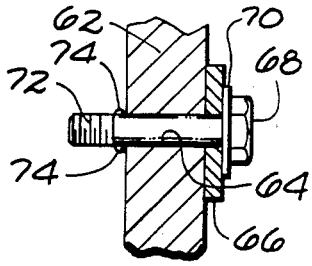
FIG. 4 is an enlarged, fragmented vertical and partially sectional view taken generally along the line 4—4 of FIG. 2, illustrating the manner in which the intermediate arm is coupled to a drive wheel.
Figure 2:
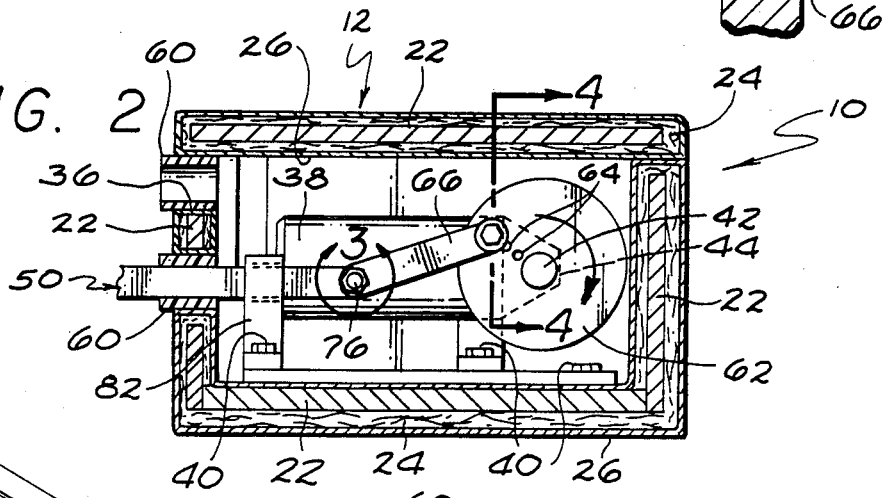
FIG. 2 is an enlarged fragmented vertical section taken generally along the line 2—2 of FIG. 1, illustrating the interior of the container, and specifically the manner in which the elongated arm is coupled with the electric motor.

The opposite end of the intermediate arm 66, which is pivotally attached to the elongated arm 50, can be attached with a standard nut and bolt arrangement 76. If desired, however, the nut and bolt arrangement can be replaced with a dual pin arrangement as illustrated in FIG. 3. There, an enlarged bolt-like pin 78 is retained in place by a retaining pin 80. This has the advantage of facilitating separation of the elongated arm 50 from the intermediate arm 66 when desired for storage or transportation purposes.

A rigid guide 82 surrounds a portion of the elongated arm 50 within the container 12, and is secured to the bottom of the base portion 14. This guide 82, in connection with the reciprocating arm aperture 36 through the container, ensures that the elongated arm 50 moves in a reciprocating and substantially linear manner in response to rotation of the drive wheel 62. In this regard, it should be apparent that rotation of the drive shaft 42, which results in a corresponding rotation of the drive wheel 62, alternatively pulls and pushes on the elongated arm 50 through the intermediate arm 66. By pivotally attaching the intermediate arm 66 to both the elongated arm 50 and the drive wheel 62, the up and down movement of the attachment point (drive wheel aperture 64) between the intermediate arm and the drive wheel is absorbed by the intermediate arm, thus permitting a smooth linear reciprocating motion of the elongated arm 50.

Further, the reciprocation stroke of the elongated arm 50 can be adjusted by the selection of the particular drive wheel aperture 64 to which the intermediate arm 66 is connected. More specifically, selection of a drive aperture 64 close to the axis of rotation of the drive wheel 62 will result in a minimal reciprocation stroke. Conversely, selection of a drive wheel aperture 64 near the circumference of the drive wheel 62 will result in a maximal reciprocation stroke.

A male glans engaging attachment 84 can be secured to the second end 54 of the elongated arm 50 by the adjustable band 56. The illustrated male glans engaging attachment 84 (FIG. 1) includes a rigid clear plastic bell 86 having a tubular shaft 88 projecting therefrom, which shaft is held securely within the adjustable band 56. A soft tubular sleeve 90, preferably constructed of Latex, is cuffed over the large rim of the bell 86 opposite the tubular shaft 88, in a manner forming a receptacle for the glans penis (not shown). A flexible tube 92 extends from the free end of the tubular shaft 88 to a constricting valve 94. This effectively places the interior of the bell 86 in fluid communication with the valve 94. The illustrated valve includes an adjustment knob 96 which permits the user to adjust the amount of air permitted to flow through the valve and into or out of the flexible tube 92. A suitable valve is manufactured and sold as Pneu-Trol Model No. F 10 B, by Deltrol Fluid Products of Bellwood, Ill. 60104.

To use the apparatus 10, the user would select a sleeve 90 having a dimension so that when cuffed over the bell 86, the user's glans penis is fit snugly within the sleeve portion. Before inserting the glans penis, a lubricant such as Astroglide or KY would be applied to the sleeve 90. After the motor was activated, the speed of reciprocation of the elongated arm 50 can be controlled by adjustment of the rheostat 48. The reciprocating action of the elongated arm 50, and thus the male glans engaging attachment 84, creates a measure of suction within the bell 86 when the sleeve 90 is moved with respect to the glans penis. This suction can be controlled by means of the valve 94. A greater suction can be achieved by closing the valve 94, and lesser suction can be achieved opening the valve.

Figure 5:
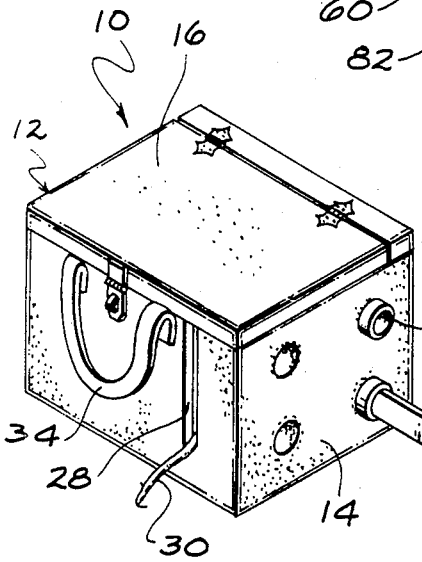
FIG. 5 is a perspective view similar to FIG. 1 of another preferred form of the stimulation apparatus of the present invention, illustrating use of an alternative glans engaging attachment adapted specially for use by females.

As illustrated in FIG. 5, the sexual stimulation apparatus 10 of the present invention is not intended for use by males only. In fact, the male glans engaging attachment 84 can be readily removed from the elongated arm 50 by simply loosening the adjustable band 56, and removing the various components thereof. A female glans engaging attachment 98 can be then placed proximate the second end 54 of the elongated arm 50, to convert the apparatus 10 for female use. The female glans engaging attachment 98 includes a dildo member 100 having an outwardly projecting shaft 102 which can be secured within the adjustable band 56 in the same manner as the tubular shaft 88 was secured therein. With this slight change in configuration, the sexual stimulation apparatus 10 is operated in virtually an identical fashion as described above in connection with the first embodiment. The only difference between the embodiments of FIG. 1 through 4 and FIG. 5 are found in the engaging attachments 84 and 98, wherein one is intended to engage the glans penis and the other is intended for vaginal insertion and/or engagement with the glans clitoridis.

Figure 6:
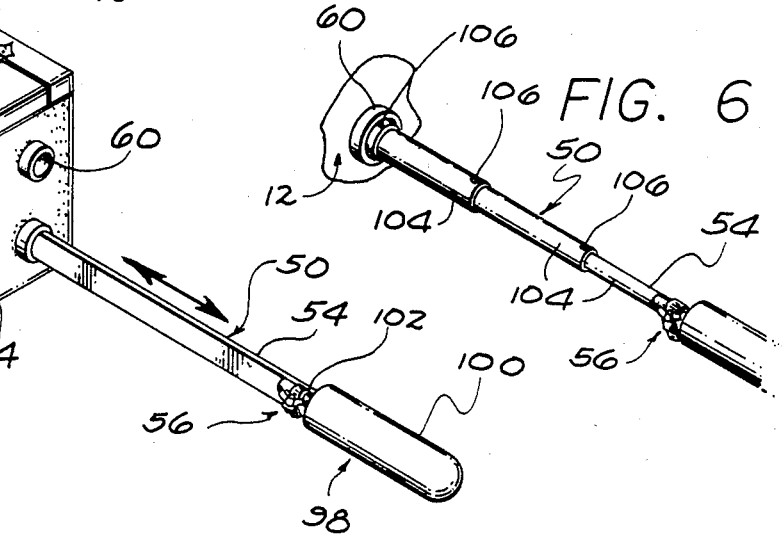
FIG. 6 is a fragmented perspective view of an alternative elongated arm comprising a plurality of telescoping sections which are held an extended configuration by spring-loaded ball locks.

When not in use, it is preferred that the elongated arm 50 be detached from the intermediate arm 66 and, if possible, stored within the container 12. Alternatively, as shown in FIG. 6, the elongated arm can be constructed of a plurality of telescoping sections 104 which are held in an extended configuration by spring-loaded ball locks 106 not unlike the spring loaded balls 74 of the bolt 68. With such a modified elongated arm 50, rather than disassociating the elongated arm from the intermediate arm 66, the user would only have to collapse or telescope the arm within itself for transportation or storage purposes.

From the foregoing it is to be appreciated that the novel sexual stimulation apparatus 10 is powered by ordinary household electrical current, is lightweight and can be carried about freely, is easy to clean and store, and can be used by either males or females. The fact that the glans engaging attachments 84 and 98 are removable from the remainder of the apparatus 10, permits easy cleaning of the attachments after use. Further, it should be apparent that the apparatus of the present invention enables the user to achieve an orgasm without exchanging body fluids with a partner, and is fully adjustable to meet the particular needs of the user. Finally, it should be apparent that besides being useful in providing a safe manner for attaining sexual gratification, the apparatus 10 of the present invention can also be used to facilitate the collection of semen for artificial insemination purposes.

Although several embodiments of the invention have been described in detail for purposes of illustration, various modifications may be made without departing from the spirit and scope of the invention. Accordingly, the invention is not to be limited, except as by the appended claims.

I claim:

1. A sexual stimulation apparatus, comprising:

motor means for rotating a drive shaft coupled to the motor means;

an elongated arm having a first end situated proximate to the drive shaft and extending away therefrom to a second end;

means for coupling the first end of the elongated arm to the drive shaft in a manner translating the rotational motion of the drive shaft into reciprocating and substantially linear motion of the elongated arm along its longitudinal axis, the coupling means including means for selectively adjusting the length of the reciprocation stroke of the elongated arm;

means for surrounding the motor means to provide a sound-insulating barrier, the surrounding means including passage means for permitting passage of the elongated arm therethrough;

a power supply means including means for controlling the motor means; and means for engaging the glans of a user to provide the desired sexual stimulation, the engaging means being attached to the elongated arm proximate its second end: wherein the engaging means includes a dildo member having a projecting shaft held securely adjacent the second end of the elongated arm, and a rigid bell having a soft tubular sleeve placed on the bell in a manner forming a receptacle for the glans penis, said rigid bell including adjustable valve mean for providing suction whereby the user can adjust the amount of suction on the glans penis when situated within the receptacle, only one of said engaging means being connected to said elongated arm at any one time.

2. A stimulation apparatus as set forth in claim 1, wherein the motor means includes an electric motor and gear means interposed between the electric motor and the drive shaft for translating a high rate of rotation of the electric motor into a slower rate of rotation of the drive shaft, and wherein the controlling means includes a rheostat for controlling the speed of the electric motor.

3. A stimulation apparatus as set forth in claim 2, wherein the coupling means includes a drive wheel attached to the drive shaft and having a plurality of apertures therethrough radially spaced from one another, and an intermediate arm pivotally attached at one end to the first end of the elongated arm, the intermediate arm being further pivotally attached at another end to the drive wheel at one of the drive wheel apertures.

4. A stimulation apparatus as set forth in claim 3, wherein the elongated arm includes a plurality of telescoping sections which are held in an extended configuration by lock means.

5. A motorized device for providing sexual stimulation to a user, the device comprising:

a box-like container including a base portion, a lid hinged to the base portion, and at least one aperture through the base portion, wherein the container is constructed, at least in part, of sound insulating material so that noise generated within the container is greatly diminished exteriorly thereto;

motor means positioned within the container and secured to the base portion, the motor means including an electric motor which turns a drive shaft;

power supply and control means extending from a power source, through the container, to the electric motor, the power supply and control means including a rheostat for controlling the speed of the electric motor;

a drive wheel attached to the drive shaft;

an elongated arm extending through the at least one container aperture and having a first end situated within the container proximate the drive wheel and a second end opposite the first end;

means for selectively coupling the first end of the elongated arm to the drive wheel in a manner translating the rotational motion of the drive shaft into reciprocating and substantially linear motion of the elongated arm along its longitudinal axis, wherein the attachment of the coupling means to the drive wheel can be varied to adjust the length of the reciprocation stroke of the elongated arm; and means for engaging the glans of a user to provide the desired sexual stimulation, the engaging means being held proximate to the second end of the elongated arm: wherein the engaging means includes a rigid bell and a soft tubular sleeve placed on and extending out from the bell in a manner forming a receptacle for the glans penis.

6. A motorized device as set forth in claim 5, wherein the container includes vent means for air circulation within the interior of the container, and handle means for carrying the motorized device.

7. A motorized device as set forth in claim 5, wherein the motor means includes gear means interposed between the electric motor and the drive shaft for translating a higher rate of rotation of the electric motor into a slower rate of rotation for the drive shaft.

8. A motorized device as set forth in claim 7, wherein the power supply and control means includes a power cable having the rheostat and an on/off switch.

9. A motorized device as set forth in claim 5, wherein the drive wheel includes a plurality of apertures therethrough radially spaced from one another, and wherein the coupling means attaches to the drive wheel at any one of the drive wheel apertures.

10. A motorized device as set forth in claim 9, wherein the coupling means includes an intermediate arm pivotally attached at one end to the first end of the elongated arm, which intermediate arm is further pivotally attached at another end to the drive wheel.

11. A motorized device as set forth in claim 10, wherein the attachment between the intermediate arm and the drive wheel is effected through use of a bolt which extends through both the intermediate arm and the drive wheel, the bolt including spring-loaded ball means for preventing unintentional separation of the intermediate arm from the drive wheel.

12. A motorized device as set forth in claim 5, wherein the coupling means includes a rigid guide for the elongated arm, which guide, in connection with the at least one container aperture, restricts the elongated arm to reciprocating and substantially linear motion along its longitudinal axis.

13. A motorized device as set forth in claim 5, wherein the elongated arm includes a plurality of telescoping sections which are held in an extended configuration by spring-loaded ball lock means.

14. A motorized device as set forth in claim 5, wherein the engaging means includes a dildo member having a projecting shaft held securely adjacent the second end of the elongated arm.

15. A motorized device as set forth in claim 15, wherein a flexible tube extends from the bell to a constricting valve means to place the interior of the bell in fluid communication with the valve means, the valve means being adjustable whereby the user can adjust the amount of suction on the glans penis within the receptacle.

16. A sexual stimulation apparatus, comprising:

a box-like container including a base portion, a lid hinged to the base portion, vent means for providing air circulation within the interior of the container, handle means for carrying the container, and at least one aperture through the base portion, wherein the container is constructed, at least in part, of sound insulating material so that noise generated within the container is greatly diminished exteriorly thereto;

motor means positioned within the container and secured to the base portion, the motor means including an electric motor which turns a drive shaft, and gear means interposed between the electric motor and the drive shaft for translating a high rate of rotation of the electric motor into a slower rate of rotation of the drive shaft;

power supply and control means extending from a power source, through the container, to the electric motor, the power supply an control means including an on/off switch and a rheostat, both separate from the container;

a drive wheel attached to the drive shaft, wherein the drive wheel includes a plurality of apertures radially spaced from one another;

an elongated arm extending through the at least one container aperture and having a first end situated within the container proximate the drive wheel and a second end opposite the first end;

means for selectively coupling the first end of the elongated arm to the drive wheel in a manner translating the rotational motion of the drive shaft into reciprocating and substantially linear motion of the elongated arm along its longitudinal axis, wherein the coupling means can be varied to adjust the length of the reciprocation stroke of the elongated arm, the coupling means including an intermediate arm pivotally attached at one end to the first end of the elongated arm, which intermediate arm is further pivotally attached at another end to the drive wheel at one of the drive wheel apertures;

a rigid guide for the elongated arm, which guide, in connection with the container aperture, positions the elongated arm to ensure reciprocating and substantially linear motion of the elongated arm along its longitudinal axis;

an adjustable band situated proximate the second end of the elongated arm; and means for engaging the glans of a user to provide the desired sexual stimulation, the engaging means being held proximate the second end of the elongated arm by the adjustable band; wherein the engaging means includes one of a dildo member having a projecting shaft held securely adjacent the second end of the elongated arm, and a rigid bell having a soft tubular sleeve placed on the bell in a manner forming a receptacle for the glans penis, said rigid bell including adjustable valve means for providing suction whereby the user can adjust the amount of suction on the glans penis when situated within the receptacle, only one of said engaging means being connected to said elongated arm at any one time.

17. A stimiulation apparatus as set forth in claim 16, wherein said rigid bell has a projecting tubular shaft held securely within said adjustble band.

18. A stimulation apparatus as set forth in claim 1, wherein the power supply means is a power cable including an on/off switch and a rheostat for controlling the speed of the motor means.

19. A stimulation apparatus as set forth in claim 16, wherein the elongated arm includes a plurality of telescoping sections which are held in an extended configuration by spring-loaded ball lock means.

* * * * *

UNITED STATES PATENT AND TRADEMARK OFFICE

CERTIFICATE OF CORRECTION

PATENT NO. : 4,790,296

DATED : December 13, 1988

INVENTOR(S) : Daniel A. Segal

It is certified that error appears in the above-identified patent and that said Letters Patent is hereby corrected as shown below:

In Column 2, line 42, delete the word "in" and insert therefor --is--.

In Column 3, line 38, insert the word "in" between the words "held" and "an."

In Column 7, line 10, delete the word "mean" and insert therefor --means--.

In Column 8, line 13, delete the number "7" and insert therefor --5--.

In Column 8, line 46, add the words ", only one of said engaging means being connected to said elongated arm at any one time" before the period at the end of the sentence.

In Column 8, line 47, delete the number "15" and insert therefor --5--.

In Column 9, line 5, delete the word "an" and insert therefor --and--.

UNITED STATES PATENT AND TRADEMARK OFFICE

CERTIFICATE OF CORRECTION

PATENT NO. : 4,790,296

DATED : December 13, 1988

INVENTOR(S) : Daniel A. Segal

It is certified that error appears in the above-identified patent and that said Letters Patent is hereby corrected as shown below:

In Column 10, line 8, delete the ";" and insert therefor --,--.

In Column 10, line 20, delete the word "stimiulation" and insert therefor --stimulation--.

Signed and Sealed this

Twenty-first Day of May, 1991

*Attest:*

HARRY F. MANBECK, JR.

*Attesting Officer*

*Commissioner of Patents and Trademarks*